US008857152B2

(12) United States Patent
Whitt et al.

(10) Patent No.: US 8,857,152 B2
(45) Date of Patent: Oct. 14, 2014

(54) SYSTEM AND METHOD FOR UNLOADING HYDROCARBON EMISSIONS FROM AN EXHAUST AFTER-TREATMENT DEVICE

(75) Inventors: Christopher Whitt, Howell, MI (US); Rebecca J. Darr, Milford, MI (US); Thomas Larose, Jr., Redford, MI (US); Sarah Funk, Canton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 741 days.

(21) Appl. No.: 12/974,027

(22) Filed: Dec. 21, 2010

(65) Prior Publication Data

US 2012/0151900 A1 Jun. 21, 2012

(51) Int. Cl.

| | |
|---|---|
| ***F01N 9/00*** | (2006.01) |
| ***F02D 41/08*** | (2006.01) |
| ***F02D 41/14*** | (2006.01) |
| ***F02D 41/02*** | (2006.01) |

(52) U.S. Cl.

CPC ..... *F02D 41/027* (2013.01); *F02D 41/08* (2013.01); *F02D 41/1459* (2013.01); *F02D 41/0205* (2013.01)

USPC ..... 60/274; 60/284; 60/285

(58) Field of Classification Search

USPC ..... 60/274, 284, 285

See application file for complete search history.

(56) References Cited

U.S. PATENT DOCUMENTS

| | | | | |
|---|---|---|---|---|
| 3,657,881 | A * | 4/1972 | Amann et al. | 60/794 |
| 4,452,200 | A * | 6/1984 | Tsutsumi et al. | 123/339.14 |
| 6,598,387 | B2 * | 7/2003 | Carberry et al. | 60/297 |
| 6,978,602 | B2 * | 12/2005 | Ohtake et al. | 60/295 |
| 7,267,633 | B2 * | 9/2007 | Hitch et al. | 477/98 |
| 2004/0105801 | A1 * | 6/2004 | Sato et al. | 423/212 |
| 2006/0064967 | A1 * | 3/2006 | Frank et al. | 60/284 |
| 2008/0163610 | A1 * | 7/2008 | Baird et al. | 60/295 |

* cited by examiner

*Primary Examiner* — Kenneth Bomberg
*Assistant Examiner* — Brandon Lee
(74) *Attorney, Agent, or Firm* — Quinn Law Group, PLLC

(57) ABSTRACT

A method unloads hydrocarbon emissions deposited by an exhaust gas on an after-treatment device that is employed in an exhaust system for an internal combustion engine. The method includes determining whether the engine has been operating at a preset idle speed for a predetermined amount of time. The method also includes increasing the preset idle speed by a predetermined value if the engine has been operating at a preset idle speed for a predetermined amount of time. The increasing of the engine idle speed increases a flow rate of the exhaust gas to the after-treatment device and unloads the deposited hydrocarbon emissions. A system for unloading hydrocarbon emissions deposited on an after-treatment device and a vehicle employing such a system are also disclosed.

17 Claims, 1 Drawing Sheet

SYSTEM AND METHOD FOR UNLOADING HYDROCARBON EMISSIONS FROM AN EXHAUST AFTER-TREATMENT DEVICE

TECHNICAL FIELD

The present invention is drawn to a system and a method for unloading hydrocarbon emissions from an exhaust after-treatment device for an internal combustion engine.

BACKGROUND

Various exhaust after-treatment devices, such as diesel particulate filters, three-way catalysts, and other devices, have been developed to effectively limit exhaust emissions from internal combustion engines. In the case of compression-ignition or diesel engines, a great deal of effort continues to be expended to develop practical and efficient devices and methods for reducing emissions of largely carbonaceous particulates in exhaust gases.

An oxidation catalyst is one of the devices that are often provided in diesel engines for such a purpose. Such an oxidation catalyst is typically employed in order to oxidize and burn hydrocarbon emissions present in the exhaust flow. However, when a diesel engine is operated at idle for an extended period of time, hydrocarbon emissions may become deposited on the oxidation catalyst. A significant accumulation of hydrocarbon emissions on the oxidation catalyst may cause elevated temperatures and eventual damage to the catalyst. A similar concern may develop in three-way catalysts that are commonly used in spark-ignition or gasoline engines.

SUMMARY

A method of unloading hydrocarbon emissions deposited by an exhaust gas on an after-treatment device that is employed in an exhaust system for an internal combustion engine includes determining whether the engine has been operating at a preset idle speed for a predetermined amount of time. The method also includes increasing the preset idle speed by a predetermined value if the engine has been operating at the preset idle speed for a predetermined amount of time. The increasing of the engine idle speed increases a flow rate of the exhaust gas to the after-treatment device and unloads the deposited hydrocarbon emissions.

The engine may be one of a diesel type and a gasoline type. If the engine is a diesel type, the after-treatment device may include at least one of a diesel oxidation catalyst, a selective catalytic reduction catalyst, and a diesel particulate filter. If the engine is a gasoline type, the after-treatment device may include a three-way catalytic converter.

The method may include determining whether the engine has been operating at a sub-freezing temperature. Furthermore, the method may include increasing the preset idle speed by the predetermined value if the engine has been operating at the preset idle speed for the predetermined amount of time and at the sub-freezing temperature.

Engine operation at the preset idle speed and at the sub-freezing temperature for a predetermined amount of time may be indicative of a predetermined amount of hydrocarbon emissions being deposited on the after-treatment device.

The engine may be employed in a vehicle having at least one of a neutral mode and a park mode. The method may also include determining whether the vehicle is in one of the park mode and the neutral mode, and the act of increasing the preset idle speed by a predetermined value may be accomplished if the vehicle is in one of the park mode and the neutral mode.

The method may additionally include enabling an elevated-idle switch operatively connected to the engine prior to increasing the preset idle speed by a predetermined value.

Each of the acts of determining whether the engine has been operating at a preset idle speed for a predetermined amount of time, increasing the preset idle speed by a predetermined value, determining whether the vehicle is in one of the park mode and the neutral mode, and enabling an elevated-idle may be executed by a controller.

A system for unloading hydrocarbon emissions deposited on an after-treatment device and a vehicle employing such a system are also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
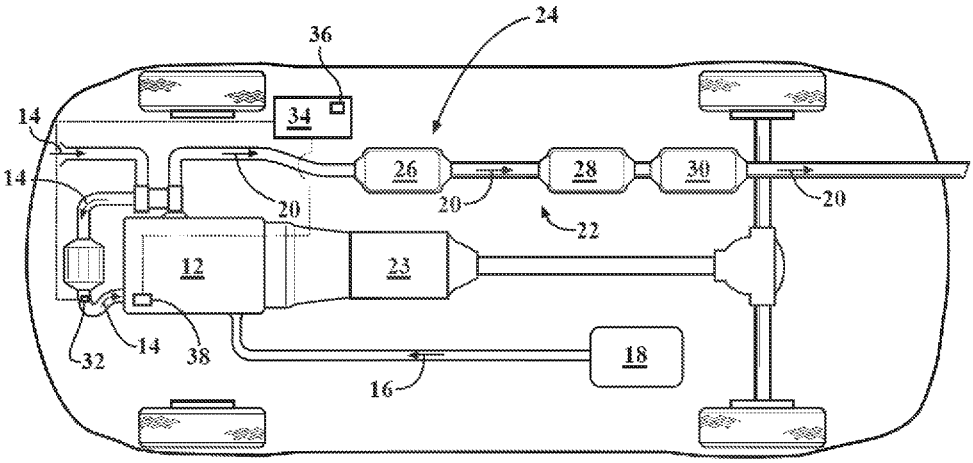
FIG. 1 is a schematic illustration of a vehicle with an engine connected to an exhaust system having a series of exhaust after-treatment devices.

Referring to the drawings, wherein like reference numbers refer to like components throughout the several views, FIG. 1 schematically depicts a motor vehicle 10. The vehicle 10 includes an internal combustion engine 12. As shown, the engine 12 is a compression-ignition or a diesel engine. The internal combustion in the diesel engine 12 occurs when a specific amount of ambient air flow 14 is mixed with a metered amount of fuel 16 supplied from an on-board fuel tank 18, and the resultant air-fuel mixture is compressed inside the engine's cylinders (not shown). An exhaust gas 20 is emitted from the engine 12 as a by-product of combustion, and is removed to the ambient through an exhaust system 22.

The vehicle 10 also includes a transmission 23 that is operatively connected to engine 12 for transmitting engine torque to power the vehicle. The transmission 23 may either be an automatic transmission or a manual transmission, as understood by those skilled in the art. The transmission 23 includes an appropriate gear-train arrangement, which is not shown, but the existence of which will be appreciated by those skilled in the art. Such a gear-train inside the transmission 23 is configured to provide the vehicle with a drive mode, a reverse mode, and, if the transmission is an automatic type, also a park mode. The transmission 23 may additionally include a neutral mode.

The vehicle 10 additionally includes a system 24. The system 24 includes the exhaust system 22 and is configured for unloading hydrocarbon emissions deposited by exhaust gas 20 on an after-treatment device positioned in the exhaust system. As shown in FIG. 1, the exhaust system 22 includes a series of exhaust after-treatment devices, shown as a diesel oxidation catalyst 26, a selective catalytic reduction (SCR) catalyst 28, and a diesel particulate filter 30. The shown series of exhaust after-treatment devices 26, 28, and 30 is configured to catalyze the exhaust gas 20, thus reducing various exhaust emissions of the engine 12.

In particular, the diesel oxidation catalyst 26 is adapted to receive exhaust gas 20 from the engine 12 to oxidize and burn hydrocarbon emissions present in the exhaust gas. Following the diesel oxidation catalyst 26, exhaust gas 20 is routed to the SCR catalyst 28, which is employed to reduce the emission of $NO_R$. A reductant, generally termed "diesel-exhaust-fluid" or DEF, may be supplied to the stream of exhaust gas 20 in the SCR catalyst 28 to thereby aid in the reduction of $NO_R$. After the exhaust gas 20 exits the SCR catalyst 28, but before it is allowed to pass to the atmosphere, the gas is routed through the diesel particulate filter 30 where the sooty particulate matter emitted from engine 12 is collected and disposed. Although, as shown, the SCR catalyst 28 is positioned upstream of the diesel particulate filter 30, the SCR catalyst may also be positioned downstream of the diesel particulate filter without affecting the effectiveness of the series of exhaust after-treatment devices 26, 28, and 30 in the after-treatment of the exhaust gas 20.

Although a compression-ignition engine is shown and described with respect to FIG. 1, the system 24 may similarly be implemented for a spark-ignition or gasoline engine (not shown). In an exhaust system of such a gasoline engine, an exhaust after-treatment device appropriate for gasoline engines may include a three-way catalyst, which may be used in addition to or in place of some or all of the diesel specific exhaust after-treatment devices that are depicted in FIG. 1. As understood by those skilled in the art, a three-way catalytic converter is an exhaust after-treatment device that has three simultaneous tasks, i) oxidation of nitrogen oxides, ii) oxidation of carbon monoxide, and iii) oxidation of unburned hydrocarbons.

Typically, hydrocarbon emissions emitted by the engine 12 during normal operating conditions as part of the exhaust gas 20 are either oxidized by the diesel oxidation catalyst 26, or slipped-off and exhausted to the ambient. When the engine 12 is operating at sub-freezing ambient temperatures the combustion in the engine may be unstable or incomplete such that the exhaust gas 20 exiting the engine may include an increased amount of hydrocarbon emissions. Such an increased amount of hydrocarbon emissions is typically the result of a sub-optimal fuel-air ratio of the combustible mixture entering the engine 12. Increased hydrocarbon emissions are especially likely when ambient air flow 14 enters the engine 12 at sub-freezing temperatures while the engine is operating at idle speed. The temperature of the ambient air flow 14 may be sensed by a sensor 32.

Experience has shown that an increase in the mass of hydrocarbons emitted by the engine 12 during the above conditions may be significant enough such that the diesel oxidation catalyst 26, the SCR catalyst 28, and the diesel particulate filter 30 are neither capable of oxidizing nor of slipping the hydrocarbons off into the ambient at a sufficient rate. Consequently, the diesel oxidation catalyst 26, the SCR catalyst 28, and the diesel particulate filter 30 may be susceptible to having the hydrocarbon emissions deposited thereon. The increased hydrocarbon emissions may initially load up the diesel oxidation catalyst 26. Following the diesel oxidation catalyst 26, the increased hydrocarbon emissions may load up the SCR catalyst 28, and, eventually, may load up the diesel particulate filter 30. Such loading-up of the diesel oxidation catalyst 26, the SCR catalyst 28, and the diesel particulate filter 30 may significantly reduce the operating efficiency of this series of exhaust after-treatment devices.

The system 24 additionally includes a controller 34 that is operatively connected to engine 10 and to the transmission 23. The controller 34 is programmed to determine whether the vehicle is in the park mode. The controller 34 is in electric communication with the sensor 32 for determination of the temperature of the ambient air flow 14. The controller 34 is also programmed to determine whether the engine 12 has been operating at a preset idle speed for a predetermined amount of time and at sub-freezing temperature. The predetermined amount of time that the engine 12 operates at the preset idle speed at sub-freezing ambient temperatures is indicative of a specific amount of hydrocarbon emissions being exhausted from the engine 12 that is sufficient to load up the diesel oxidation catalyst 26. The amount of time engine 12 operates at idle speed may be empirically determined during testing and development of the vehicle 10 and the engine 12.

The controller 34 is additionally programmed to increase the preset idle speed by a predetermined value 36 if the engine 12 has been operating at the preset idle speed during the predetermined amount of time and at a sub-freezing temperature, when the controller determines that the vehicle 10 is in the park mode. The controller 34 may also be programmed to increase the preset idle speed by a predetermined value 36 if the transmission 23 is in the neutral mode. The system 24 may also include an elevated-idle switch 38 that is operatively connected to the engine 12. The switch 38 is configured to be enabled by the controller 34 prior to the controller increasing the preset idle speed of the engine 12 by the predetermined value 36. Such increasing of the idle speed of the engine 12 acts to increase a rate and/or temperature of exhaust gas 20 flowing to the diesel oxidation catalyst 26 and is sufficient to unload the hydrocarbon emissions deposited on the diesel oxidation catalyst.

Generally, temperature of the exhaust gas 20 exiting the engine 12 at a typical preset idle speed is approximately 100 degrees C. The increase of the idle speed of the engine 12 by an empirically determined magnitude sufficient to unload the diesel oxidation catalyst 26 will increase the temperature of the exhaust gas 20 initially up to approximately 300 degrees C. Following the initial increase in the temperature of the exhaust gas 20, an exothermic reaction will take off inside the diesel oxidation catalyst 26. Thus initiated, the exothermic reaction inside the diesel oxidation catalyst 26 will cause the hydrocarbons to react inside the diesel oxidation catalyst and drive the temperatures inside the diesel oxidation catalyst up to and above approximately 400 degrees C.

The increased temperatures inside diesel oxidation catalyst 26 will be carried by the increased flow rate of exhaust gas 20 to the SCR catalyst 28, and then to the diesel particulate filter 30, thereby unloading the deposited hydrocarbons from these after-treatment devices, as well. Accordingly, when the controller 34 determines that the vehicle 10 is in the park mode, the controller may authorize the increase of the preset idle speed by the predetermined value 36 in order to unload hydrocarbons from the after-treatment devices 26, 28, and 30.

Figure 2:
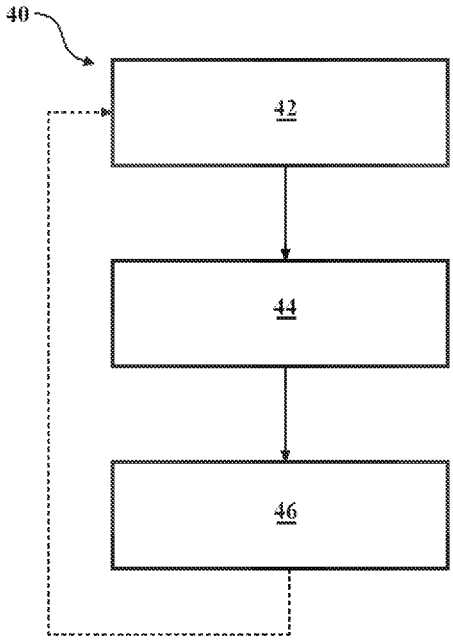
FIG. 2 is a flow diagram of a method for controlling regeneration of the exhaust after-treatment device of FIG. 1.

FIG. 2 depicts a method 40 of unloading hydrocarbon emissions deposited on any of the after-treatment devices 26, 28, and 30 as described with respect to FIG. 1. As with the system 24 above, the method 40 is similarly applicable for unloading hydrocarbon emissions deposited by an exhaust gas on an after-treatment device of a diesel engine, as well as on a gasoline engine specific after-treatment device, which may include a three-way catalyst.

Accordingly, the method commences in frame 42, where it includes using the controller 34 to determine whether the engine 12 has been operating at a preset idle speed for a predetermined amount of time. As described above, the method may also include using the controller 34 to determine whether the engine 12 has been operating at the preset idle speed at a sub-freezing temperature. The controller 34 may additionally determine whether the vehicle 10 is in one of the park mode and the neutral mode, and may authorize the increase of the preset idle speed by the predetermined value 36 if the vehicle is in one of the park mode and the neutral mode. Furthermore, the method may also include enabling an elevated-idle switch by the controller 34 prior to increasing the preset idle speed by a predetermined value.

Following frame 42, the method proceeds to frame 44, where it includes increasing by the controller 34 the preset idle speed by the predetermined value 36 if engine 12 has been operating at the preset idle speed for a predetermined amount of time. Such increasing the preset idle speed by the predetermined value 36 increases a flow rate of exhaust gas 20 first to the diesel oxidation catalyst 26, then to the SCR catalyst 28, and finally to the diesel particulate filter 30 in order to unload the deposited hydrocarbon emissions. Also, the increasing of the preset idle speed by predetermined value 36 may be accomplished if engine 12 has been operating at the preset idle speed at sub-freezing temperature during a predetermined amount of time, as described above. The method concludes in frame 46, where the flow rate of exhaust gas 20 to the diesel oxidation catalyst 26 is increased and the deposited hydrocarbon emissions are unloaded from the after-treatment devices. Following frame 46, the method may loop back to frame 42 and restart.

While the best modes for carrying out the invention have been described in detail, those familiar with the art to which this invention relates will recognize various alternative designs and embodiments for practicing the invention within the scope of the appended claims.

The invention claimed is:

1. A method of unloading hydrocarbon emissions deposited by an exhaust gas on an after-treatment device employed in an exhaust system for an internal combustion engine, comprising:

determining via a controller whether the engine has been operating at a preset idle speed at a sub-freezing ambient temperature for a predetermined amount of time; and increasing via the controller the preset idle speed by a predetermined value if the engine has been operating at the preset idle speed at the sub-freezing ambient temperature for the predetermined amount of time to thereby increase a flow rate of the exhaust gas to the after-treatment device and unload the deposited hydrocarbon emissions.

2. The method according to claim 1, wherein the engine is one of a diesel engine and a gasoline engine.

3. The method according to claim 2, wherein the engine is the diesel engine, the after-treatment device includes at least one of a diesel oxidation catalyst, a selective catalytic reduction catalyst, and a diesel particulate filter.

4. The method according to claim 1, wherein the engine is employed in a vehicle having at least one of a neutral mode and a park mode, further comprising determining whether the vehicle is in one of the park mode and the neutral mode and increasing of the preset idle speed by the predetermined value if the vehicle is in one of the park mode and the neutral mode.

5. The method according to claim 1, wherein the engine operation at the preset idle speed at the sub-freezing ambient temperature for the predetermined amount of time is indicative of a predetermined amount of hydrocarbon emissions being deposited on the after-treatment device.

6. The method according to claim 4, wherein increasing the preset idle speed by a predetermined value includes enabling an elevated-idle switch.

7. The method according to claim 6, wherein each of said determining whether the vehicle is in one of the park mode and the neutral mode, and enabling an elevated-idle switch is executed by a controller.

8. A system for unloading hydrocarbon emissions deposited via an exhaust gas generated by an internal combustion engine, comprising:

an exhaust system configured to remove the exhaust gas;

an exhaust after-treatment device operatively connected to the exhaust system and configured to catalyze the exhaust gas; and a controller operatively connected to the engine and programmed to:

determine whether the engine has been operating at a preset idle speed at a sub-freezing ambient temperature for a predetermined amount of time; and increase the preset idle speed by a predetermined value if the engine has been operating at the preset idle speed at the sub-freezing ambient temperature for the predetermined amount of time to thereby increase a flow rate of the exhaust gas to the after-treatment device and unload the hydrocarbon emissions deposited on the after-treatment device.

9. The system according to claim 8, wherein the engine is one of a diesel engine and a gasoline engine, and wherein the engine is the diesel engine, the after-treatment device includes at least one of a diesel oxidation catalyst, a selective catalytic reduction catalyst, and a diesel particulate filter.

10. The system according to claim 8, wherein the engine operation at the preset idle speed and at the sub-freezing ambient temperature for the predetermined amount of time is indicative of a predetermined amount of hydrocarbon emissions being deposited on the after-treatment device.

11. The system according to claim 8, wherein the engine is employed in a vehicle having at least one of a neutral mode and a park mode, and the controller is additionally programmed to determine whether the vehicle is in one of the park mode and the neutral mode, and is further programmed to authorize the increase of the preset idle speed by the predetermined value if the vehicle is in one of the park mode and the neutral mode.

12. The system according to claim 8, further comprising an elevated-idle switch operatively connected to the engine, wherein the controller is additionally programmed to enable the elevated-idle switch prior to increasing the preset idle speed by the predetermined value.

13. A vehicle, comprising:

an internal combustion engine that generates an exhaust gas, wherein the gas includes hydrocarbon emissions that are a byproduct of combustion;

an exhaust system configured to remove the exhaust gas from the engine;

an exhaust after-treatment device operatively connected to the exhaust system, configured to catalyze the exhaust gas, and susceptible to having the hydrocarbon emissions deposited thereon; and a controller operatively connected to the engine and programmed to:

determine whether the engine has been operating at a preset idle speed at a sub-freezing ambient temperature for a predetermined amount of time;

increase the preset idle speed by a predetermined value if the engine has been operating at the preset idle speed at the sub-freezing ambient temperature for the predetermined amount of time to thereby increase a flow rate of the exhaust gas to the after-treatment device and unload the deposited hydrocarbon emissions.

14. The vehicle according to claim 13, wherein the engine is one of a diesel engine and a gasoline engine, and wherein the engine is the diesel engine, the after-treatment device includes at least one of a diesel oxidation catalyst, a selective catalytic reduction catalyst, and a diesel particulate filter.

15. The vehicle according to claim 13, wherein the engine operation at the preset idle speed and at the sub-freezing ambient temperature for the predetermined amount of time is indicative of a predetermined amount of hydrocarbon emissions being deposited on the after-treatment device.

16. The vehicle according to claim 13, wherein the engine is employed in a vehicle having at least one of a neutral mode and a park mode, and the controller is additionally programmed to determine whether the vehicle is in one of the park mode and the neutral mode and to authorize the increase of the preset idle speed by the predetermined value if the vehicle is in one of the park mode and the neutral mode.

17. The vehicle according to claim 13, further comprising an elevated-idle switch operatively connected to the engine, wherein the controller is additionally programmed to enable the elevated-idle switch prior to increasing the preset idle speed by the predetermined value.

* * * * *